United States Patent [19]

Bennett

[11] 4,162,749

[45] Jul. 31, 1979

[54] SQUEEZABLE DISPENSER WITH OUTLET CLOSURE

[75] Inventor: Robert A. Bennett, Easton, Conn.

[73] Assignee: Risdon Manufacturing Company, Torrington, Conn.

[21] Appl. No.: 881,440

[22] Filed: Feb. 27, 1978

[51] Int. Cl.[2] ..... B05B 11/04

[52] U.S. Cl. ..... 222/633; 222/207; 222/212; 222/484; 222/522; 239/353

[58] Field of Search ..... 239/337, 353, 354; 222/193, 207, 211, 212, 522, 524, 484

[56] References Cited

U.S. PATENT DOCUMENTS

| | | | |
|---|---|---|---|
| 1,873,337 | 8/1932 | Schmitt | 239/354 |
| 2,537,226 | 1/1951 | Lindsey | 239/337 |
| 2,700,484 | 1/1955 | Rathsprecher | 222/484 X |
| 2,717,727 | 9/1955 | Robb | 222/212 X |
| 2,884,164 | 4/1959 | Kleid | 222/207 |
| 3,118,578 | 1/1964 | Collins | 222/212 X |

*Primary Examiner*—David A. Scherbel

[57] ABSTRACT

A disposable squeezable dispenser employing a flexible container filled with a mixture of air and the liquid to be dispensed. The dispenser employes only two main parts (other than the container itself) plus a ball and dip tube. One of the main parts is a hollow pull top which cooperates with the other main part in a sealing operation which prevents leakage when the dispenser is not in use.

7 Claims, 7 Drawing Figures

FIG. 1
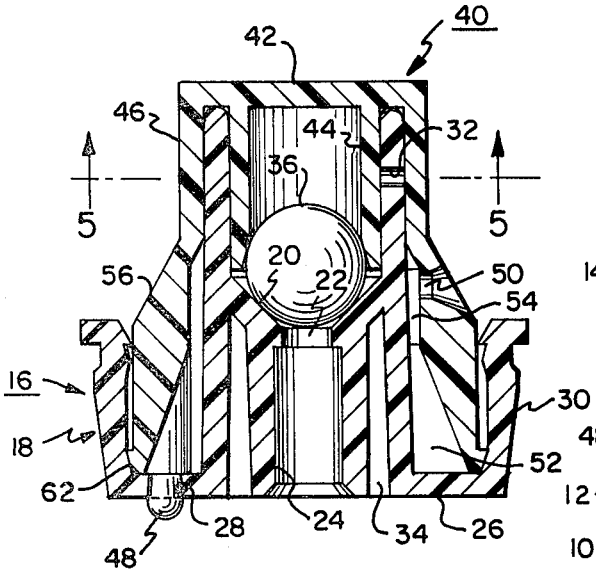
FIG. 2
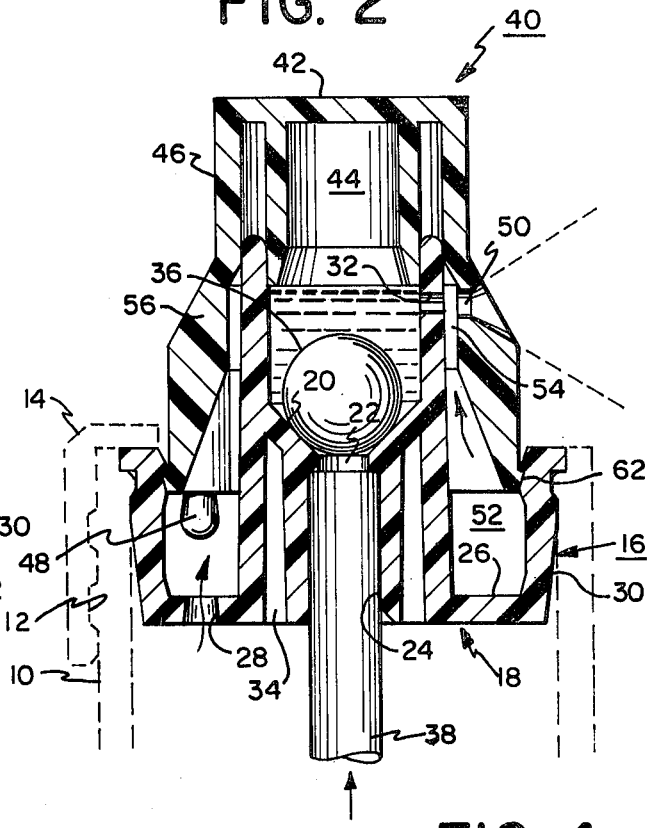
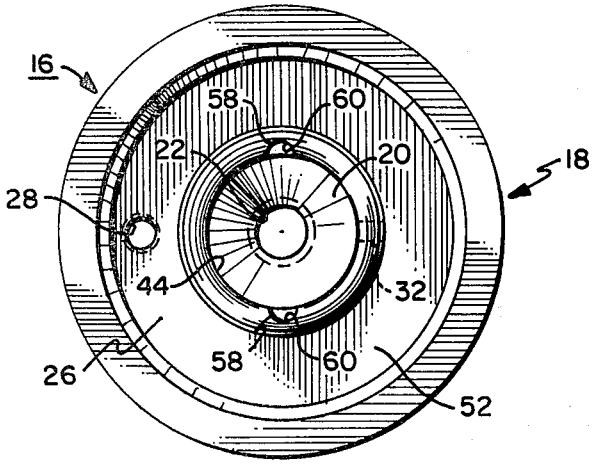
FIG. 3
FIG. 4
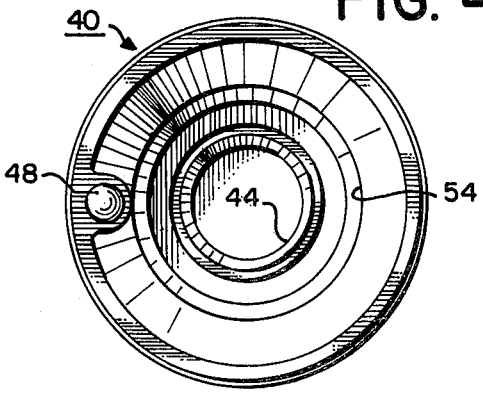
FIG. 5
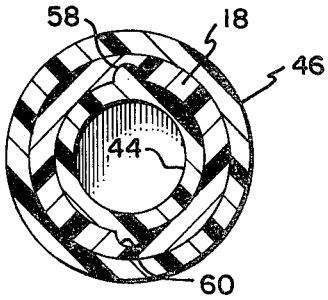

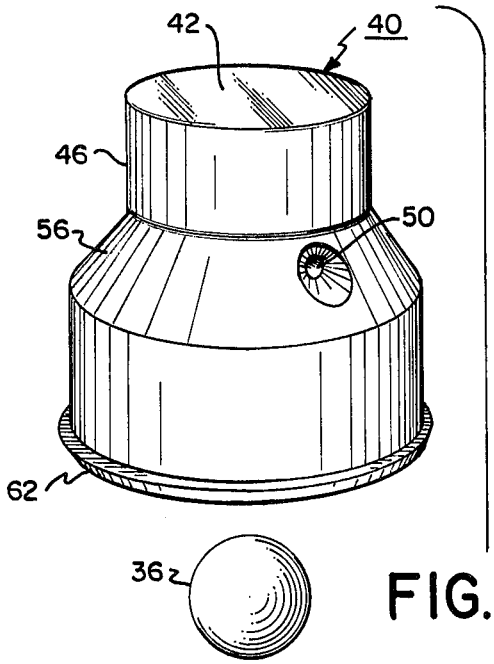
FIG. 6
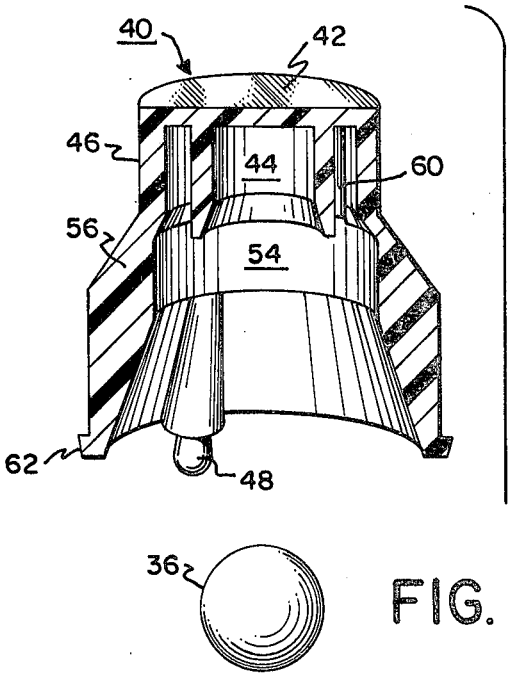
FIG. 7
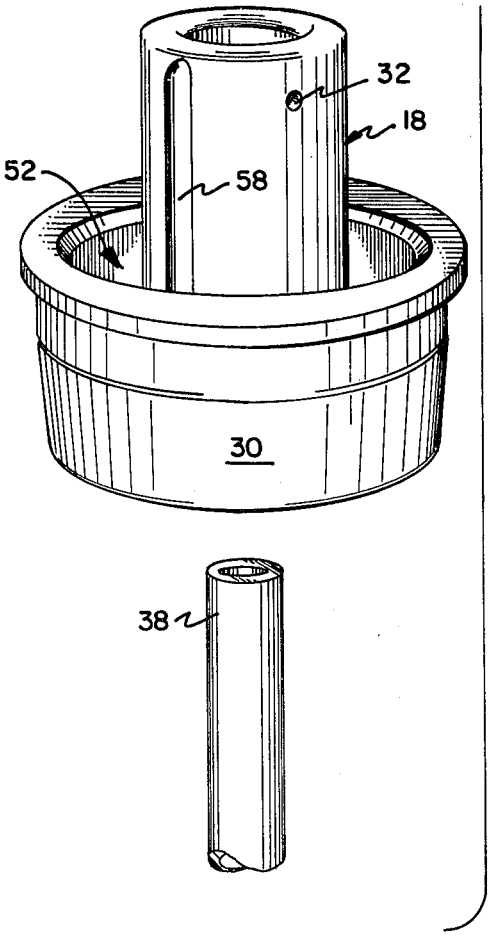
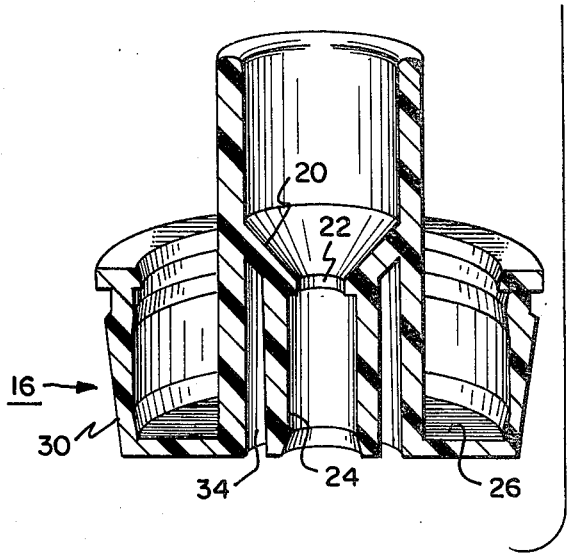

SQUEEZABLE DISPENSER WITH OUTLET CLOSURE

BACKGROUND OF THE INVENTION

This invention is directed toward a disposable squeezable dispenser employing a flexible container in which a mixture of air and liquid to be dispensed is disposed. The dispenser in addition to the container, employs only two main parts plus a ball and dip tube, substantially fewer in number and less complex in construction than previously used. Moreover, the dispenser is characterized by a unique type of sealing operation which prevents leakage when the dispenser is not in use.

SUMMARY OF THE INVENTION

In accordance with the principles of this invention, the dispenser utilizes, in addition to the squeezable container having therein a mixture of air and the liquid to be dispensed, an integral body having a vertical hollow cylindrically shaped first element open at its upper end. An inverted vertical hollow truncated cone is disposed in the first element intermediate the ends. The cone has an upper and larger opening peripherally secured to the inner wall of the first element and a lower smaller opening. The first element has a first vertical cylindrical bore with an upper end coincident with the lower opening of the cone and a lower end coincident with the lower end of the first element. A flat horizontal annulus is secured at its inner periphery to the outer periphery of the first element at its lower end and extends outward therefrom, said annulus having a second vertical bore extending therethrough. A generally cylindrical vertically elongated second element is secured at its lower end to the outer periphery of the annulus and extends upward. The outer surface of the second element is adapted to engage detachably the inner surface of the top open neck of the vertical flexible container, said first element having a third horizontal bore extending therethrough in a position adjacent but below the upper end thereof.

A ball is movable up and down in the first element between the lower end of the cone and the upper end of the first element, the diameter of the ball being smaller than the inner diameter of the first element and larger than the diameter of the smaller cone opening.

A hollow cylindrical dip tube is disposed in the first bore, the upper end of the tube being open and coincident with the lower cone opening, the lower end of the tube being open and extending past the lower end of the first element.

A hollow pull top is closed at a top end and extends downwardly. A vertical hollow cylinder open at its lower end extends downwardly from said top end into the upper end of the first element. The outer surface of the cylinder slidably engages the inner wall of the first element. A hollow generally cylindrical vertical member open at its lower end and secured at its upper end to the top end of the top extends downwardly and slidably between the outer surface of the first element and the inner surface of the second element. The member is always in sealing engagement with the inner surface of the second element and has a vertical plug at its lower end movable into and out of sealing engagement with the second bore, said member having a fourth horizontal bore extending therethrough and movable into and out of alignment with said third bore.

The body and pull top are adapted to be disposed in either a closed position in which the plug is sealed in the second bore and the third and fourth bores are out of alignment or in an open position with the top pulled outward from the body with the plug pulled out of the second bore and the third and fourth bores being disposed in alignment. When these bores are so aligned, there is a small horizontal separation between the two bores.

The inner surface of the member is so contoured that a hollow chamber is formed between the member and the outer surface of the first element. This chamber provides an air flow path as explained below.

In use, the dispenser is held vertically with the body and pull top in closed position. The top is then pulled upward. Then the container is squeezed. Air within the container is forced upward through the second bore and hollow chamber into the space between the aligned third and fourth bores. At the same time, liquid in the container is forced up through the dip tube and moves the ball upward to fill the first element above the level of the third bore. The liquid then flows outward into the space between the third and fourth bores. The resultant break up or mixing action between the flow of liquid and the flow of air produces a fine spray which is dispensed via the fourth bore.

As soon as the squeezing pressure is released, the ball falls by gravity into the cone and closes the upper end of the dip tube. However, the container can be repeatedly squeezed and the dispensing spray will be produced each time. Once the top is pushed down in the body into closed position, the plug closes the second bore, the third and fourth bores are out of alignment and the dispenser is sealed closed.

BRIEF DESCRIPTION OF THE DRAWINGS

FIG. 1 is a vertical cross section showing the body and pull top in closed position.

FIG. 2 is a view similar to FIG. 1 but showing the body and pull top in open position.

FIG. 3 is a top view of the body alone.

FIG. 4 is a bottom view of the pull top alone.

FIG. 5 is a cross section taken along line 5—5 in FIG. 1.

FIG. 6 is a cut away perspective view of the invention.

FIG. 7 is a perspective view of the invention.

DETAILED DESCRIPTION OF PREFERRED EMBODIMENT

Referring now to the Figures, a squeezable flexible container 10, disposed vertically, has an open neck 12 with a removable screw cap 14 having a central opening.

An integral body generally at 16 is provided with a vertical hollow cylindrically shaped first element 18 having an open upper end. An inverted vertical hollow truncated cone 20 is disposed within element 18 intermediate its ends. The cone has an upper and larger opening peripherally secured to the inner wall of element 18 and a smaller lower opening 22 communicating with the upper end of a first vertical cylindrical bore 24 axially aligned with element 18 and extending downward to the lower end of element 18. A flat horizontal annulus or ring 26 is secured at its inner periphery to the outer periphery of element 18 at its lower end and extends outward therefrom. Annulus 26 has a second vertical bore 28 extending therethrough in a position intermediate the inner and outer peripheries thereof. A generally cylindrical vertically elongated second element 30 axially aligned with element 18 is secured at its lower end to the outer periphery of annulus 26, and extends upward. The outer surface of element 30 engages the inside of neck 12 and cap 14 holds the element 30 in position. Element 18 has a third horizontal bore 32 extending therethrough in a position adjacent but below the upper end thereof. The body is molded in one piece and the cylindrical groove 34 shown therein employed in the molding operation has no function in the invention.

A ball 36 is movable up and down in the first element between the lower end of the cone and the upper end of element 18, the ball diameter being smaller than that of the inner diameter of the first element and larger than that of the smaller opening of the cone.

A flexible hollow cylindrical dip tube 38 is disposed in bore 24 and extends downwardly into the container 10 below the liquid level. The tube is open at both ends.

A hollow pull top shown generally at 40 has a closed top end 42. A vertical hollow cylinder 44 extends downwardly from end 42 into the upper end of element 18, the outer surface of cylinder 44 slidably engaging the inner wall of element 18. The lower end of cylinder 44 has a flared out inner opening adapted for sealing engagement with ball 36. A hollow generally cylindrical vertical member 46 axially aligned with cylinder 44 (which is aligned with element 18) extends downwards from top end 42 and flares outward and downward from an intermediate point therealong to engage slidably the inner surface of element 30. Member 46 is always in sealing engagement with this surface. Member 46 has a vertical plug 48 at its lower end which is movable into and out of sealing engagement with bore 28. Member 46 has a fourth horizontal bore 50 movable into and out of alignment with bore 32.

The inner surface of member 46 has a contour at which a hollow chamber is formed. This chamber has a lower portion 52 which defines generally a vertical hollow truncated cone 54 open at both ends and an upper portion 56 which defines a short hollow cylindrical extension to cone 56. Portion 56 is disposed between bores 32 and 50 when the body and top are in open position and always communicates with bore 50.

The body and pull top have engaged interlocking vertical cracks 58 and grooves 60 to insure proper sliding motion therebetween.

In the closed position of FIG. 1, plug 48 seals bore 28, cylinder 44 seals bore 32, ball 36 seals opening 22, and cylinder 44 seals ball 36 whereby no leakage can occur.

In the open position of FIG. 2, a circular horizontal seal 62 prevents linkage between element 30 and member 46.

The hollow chamber constituted by cone 54 and extension 56 causes the air discharged from bore 28 when the container is squeezed to be progressively more confined as it swirls upward, thus producing the desired pressure buildup to produce the desired break up or mixing of air and liquid in that portion of cylindrical region 54 disposed between aligned bores 32 and 50, as shown in FIG. 2.

Typically, all parts are formed of plastic such as polypropylene.

I claim:

1. A dispenser comprising:

an integral body having a vertical hollow cylindrically shaped first element open at its upper end, said first element having an inverted vertical hollow truncated cone disposed therein intermediate the ends, the cone having an upper and larger opening peripherally secured to the inner wall of the first element and a lower smaller opening, the first element having a first vertical cylindrical bore with an upper end coincident with the lower opening of the cone and a lower end coincident with the lower end of the first element, said body further having a flat horizontal annulus secured at its inner periphery to the outer periphery of the first element at its lower end and extending outward therefrom, said annulus having a second vertical bore extending therethrough said body also having a generally cylindrical vertically elongated second element secured at its lower end to the outer periphery of the annulus and extending upward, the outer surface of the second element being adapted to engage detachably the inner surface of the top open neck of a vertical squeezable flexible container, said first element having a third horizontal bore extending therethrough in a position adjacent but below the upper end thereof;

a ball movable up and down in the first element between the lower end of the cone and the upper end of the first element, the diameter of the ball being smaller than the inner diameter of the first element and larger than the diameter of the smaller cone opening;

a hollow cylindrical dip tube disposed in the first bore, the upper end of the tube being open and coincident with the lower cone opening, the lower end of the tube being open and extending past the lower end of the first element; and a hollow pull top closed at a top end and extending downwardly, said top having a first vertical hollow cylinder open at its lower end and extending downwardly from said top end into the upper end of the first element, the outer surface of the cylinder slidably engaging the inner wall of the first element, said top further having a hollow generally cylindrical vertical member open at its lower end and secured at its upper end to the top end of the top, said member extending downwardly and slidably between the outer surface of the first element and the inner surface of the second element, said member being always in sealing engagement with the inner surface of the second element and having a vertical plug at its lower end movable into and out of sealing engagement with the second bore, said member having a fourth horizontal bore extending therethrough and movable into and out of alignment with said third bore.

2. The dispenser of claim 1 wherein said pull top and said body have cooperating mutually engaging vertical track and groove means to insure vertical sliding alignment between said top and said body.

3. The dispenser of claim 2 wherein the inner surface of the member has a contour at which a hollow chamber communicating with said fourth bore is disposed between the inner surface of the member and the outer surface of the first element.

4. The dispenser of claim 3 further including said container, said container having an air-liquid mixture therein, said second element engaging the neck of the container, said tube extending into said container below the liquid level thereof.

5. The dispenser of claim 4 wherein said body and top have a closed position in which said plug is disposed in said second bore and the fourth bore is out of alignment with said third bore and an open position at which the plug is separated from the second bore and the third and fourth bores are horizontally aligned, the aligned bores being separated by a small horizontal space communicating with said hollow chamber.

6. The dispenser of claim 5 wherein the cooperating means includes two parallel oppositely disposed sets of tracks and grooves.

7. The dispenser of claim 3 wherein said chamber has a lower portion having the general shape of an upright vertical truncated cone and has an upper portion having the general shape of a cylindrical extension of the lower portion.

* * * * *